US011781567B2

(12) United States Patent
Lee et al.

(10) Patent No.: US 11,781,567 B2
(45) Date of Patent: Oct. 10, 2023

(54) CENTRIFUGAL FAN

(71) Applicant: Delta Electronics, Inc., Taoyuan (TW)

(72) Inventors: Chin-Hung Lee, Taoyuan (TW); Chih-Wei Chan, Taoyuan (TW); Ya-Ting Chang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 17/950,147

(22) Filed: Sep. 22, 2022

(65) Prior Publication Data

US 2023/0093736 A1 Mar. 23, 2023

Related U.S. Application Data

(60) Provisional application No. 63/247,691, filed on Sep. 23, 2021.

(51) Int. Cl.

| | |
|---|---|
| ***F04D 29/42*** | (2006.01) |
| ***F04D 29/66*** | (2006.01) |
| ***F04D 29/44*** | (2006.01) |
| ***F04D 17/16*** | (2006.01) |
| ***F04D 29/28*** | (2006.01) |

(52) U.S. Cl.

CPC ..... *F04D 29/667* (2013.01); *F04D 17/16* (2013.01); *F04D 29/281* (2013.01); *F04D 29/422* (2013.01); *F04D 29/4213* (2013.01); *F04D 29/4226* (2013.01); *F04D 29/441* (2013.01)

(58) Field of Classification Search

CPC ..... F04D 29/4213; F04D 29/422; F04D 29/4226; F04D 29/667; F04D 17/16

See application file for complete search history.

(56) References Cited

U.S. PATENT DOCUMENTS 6,688,379 B2 2/2004 Huang et al.
7,443,670 B2 * 10/2008 Nishi ..... F04D 29/4226 361/695
7,802,617 B2 * 9/2010 Hwang ..... G06F 1/20 165/122

(Continued)

FOREIGN PATENT DOCUMENTS

CN 111963480 A * 11/2020
JP 11324993 A * 11/1999

*Primary Examiner* — Justin D Seabe

(74) *Attorney, Agent, or Firm* — KIRTON McCONKIE; Evan R. Witt

(57) ABSTRACT

A centrifugal fan is disclosed and includes a housing, a fan wheel, a first throat portion and a second throat portion. The housing includes a lower cover connected to an upper cover through a peripheral wall to form an accommodation space and an outlet. The upper cover includes an inlet communicated with the outlet. The fan wheel is disposed on the lower cover and accommodated in the accommodation space. The fan wheel is rotated along a rotation direction. The first throat portion is disposed adjacent to a lateral end of the outlet and protrudes from the peripheral wall toward the accommodation space. The second throat portion is disposed adjacent to another lateral end of the outlet, and protrudes from the peripheral wall toward the accommodation space. When the fan wheel is rotated along the rotational direction, an airflow is guided from the first throat portion to the second throat portion.

21 Claims, 15 Drawing Sheets

(56) References Cited

U.S. PATENT DOCUMENTS

| | | | | |
|---|---|---|---|---|
| 7,883,312 | B2 * | 2/2011 | Eguchi | F04D 29/665 415/206 |
| 7,887,290 | B2 * | 2/2011 | Chen | F04D 29/663 415/206 |
| 7,909,571 | B2 * | 3/2011 | Wu | F04D 29/4213 415/206 |
| 8,251,642 | B2 * | 8/2012 | Hwang | F04D 17/16 415/206 |
| 8,794,915 | B2 * | 8/2014 | Yamashita | F04D 25/0613 415/206 |
| 9,322,408 | B2 * | 4/2016 | Tsai | F04D 29/4226 |
| 9,518,584 | B2 | 12/2016 | Chen et al. | |
| 9,568,019 | B2 | 2/2017 | Lu et al. | |
| 10,415,601 | B2 * | 9/2019 | Thawani | F04D 29/281 |
| 2008/0030949 | A1 * | 2/2008 | Hsiao | G06F 1/203 361/689 |

* cited by examiner

CENTRIFUGAL FAN

CROSS-REFERENCE TO RELATED APPLICATION

This application claims the benefit of U.S. Provisional Application No. 63/247,691 filed on Sep. 23, 2021, and entitled "NOISE-REDUCTION CENTRIFUGAL FAN". The entireties of the above-mentioned patent application are incorporated herein by reference for all purposes.

FIELD OF THE INVENTION

The present disclosure relates to a fan, and more particularly to a centrifugal fan with the design of a plurality of throat portions disposed in the flow tunnel and an irregular inlet to reduce the fluid velocity thereby achieving the effect of reducing the high frequency noise.

BACKGROUND OF THE INVENTION

At present, the types of fans can be mainly divided into an axial fan and a centrifugal fan. The operation mode of the centrifugal fan is that the air is inhaled in the axial direction of the impeller of the fan, transported along the radial direction of the impeller, converged through the flow tunnel of the fan to form a high-pressure fluid, and then discharged out through the radial outlet. However, when the fluid velocity is too high, the generated high-pressure fluid will easily affect the blade passing frequency to generate the undesired noise. Therefore, how to solve the undesired noise generated by the fan has always been a major concern in the field.

When the identical fans are used in different systems, different sound performances may be caused by the influence of flow fields in different systems. Generally speaking, the conventional methods of adjusting the inlet or modifying the fan blades are used to solve the problems of the noise in the system. Although the disturbing noise caused by the inlet air velocity of the system can be solved through the method of adjusting the inlet air, the noise caused by the internal flow field or the outlet cannot be solved by the same method. As for the method of modifying the fan blades, it takes a long development time and the cost is high. Furthermore, it is still difficult to completely eliminate the noise of the fan by the conventional methods for the noise reduction of the centrifugal fan, so the user is still troubled by the noise of the fan.

Therefore, there is a need of providing a centrifugal fan with the design of a plurality of throat portions disposed in the flow tunnel and an irregular inlet to reduce the fluid velocity thereby achieving the effect of reducing the high frequency noise to obviate the drawbacks encountered by the prior arts.

SUMMARY OF THE INVENTION

An object of the present disclosure is to provide a centrifugal fan with the design of a first throat portion and second throat portion disposed in the flow tunnel, an irregular inlet and a support to reduce the fluid velocity thereby achieving the effects of reducing the noise and the prominence ratio and improving the sound quality.

Another object of the present disclosure is to provide a centrifugal fan. The second throat portion is disposed in the flow tunnel to form a deceleration mechanism, and further combined with the structure of the irregular inlet formed by punching a stage outwardly from the fan or the structure of the support disposed in the flow tunnel. Thereby, the fluid velocity is effectively reduced to achieve the effects of reducing the noise and improving the sound quality. The stage punched outwardly from the irregular inlet further forms a turning angle, and it facilitates the inlet to achieve the effects of reducing the noise of the incoming air and maintaining the air volume at the same time. Furthermore, the height of the stage punched outward from the inlet is helpful of increasing the strength of the fan and avoiding the interference between the fan wheel and the inlet. In addition, the second throat portion is spatially corresponding to the first throat portion. The first and second throat portions are disposed along the rotation direction of the fan wheel and are located at two opposite sides of the fan wheel, respectively. The second throat portion is disposed within a specific range to exert the effect of reducing the flow rate. Relative to the first airflow guided from the first throat portion to the second throat portion along the rotation direction and the second airflow blown by the fan wheel directly to the second throat portion, a third airflow in the opposite direction is generated by the second throat portion, so that the fluids are directed to collide with each other and decelerate. Furthermore, for the first and second airflows acting on the second throat portion, a fourth airflow is generated by more than one support to reduce the flow velocity of the fluids near the outlet, thereby achieving the effects of reducing noise and the prominence ratio and improving the sound quality.

A further object of the present disclosure is to provide a centrifugal fan. The second throat portion is added and corresponding to the first throat portion in the rotation direction of the fan wheel, and the second throat portion further includes a first curved wall and a second curved wall. The first curved wall faces the first airflow directed from the first throat portion to the second throat portion, and the first curved wall faces the second airflow directly blown by the fan wheel to the second throat portion. Therefore, the first curved wall is regarded as a windward surface. The distance between the first curved wall and the peripheral wall is increased along the rotation direction to form a peak, and the peak is connected to the second curved wall. The distance between the second curved wall and the peripheral wall is decreased along the rotation direction, so as to form a downstream flow of the third airflow. In this way, the third airflow formed by the second throat portion is more helpful to achieve the effects of reducing the noise and the prominence ratio. The first and second curved walls are adjustable according to the practical requirements, and allowed including a smooth surface, a convex portion, a concave portion, a gap, an interval space or cylinders, so as to improve the practicability of the second throat portion. Compared with the conventional fan that only includes the first throat portion, the centrifugal fan of the present disclosure includes the additional second throat portion, so that the sound pressure level (SPL) of the centrifugal fan is effectively reduced under the condition of the same rotational speed, and the performance of the centrifugal fan is improved. Moreover, the prominence ratio (PR) of the centrifugal fan is reduced significantly, the generation of prominent abnormal noise is avoided, and the sound quality of the centrifugal fan is optimized.

In accordance with an aspect of the present disclosure, a centrifugal fan is provided and includes a housing, a fan wheel, a first throat portion and a second throat portion. The housing includes a lower cover, a peripheral wall and an upper cover. The lower cover and the upper cover are connected through the peripheral wall to form an accommodation space and an outlet, the upper cover includes an inlet, and the inlet is in fluid communication with the outlet through the accommodation space. The fan wheel is disposed on the lower cover and accommodated in the accommodation space. The fan wheel is rotated along a rotation direction to form an airflow, which is inhaled through the inlet, flows through the accommodation space, and is exported through the outlet. The first throat portion is disposed adjacent to a lateral end of the outlet and protruding from the peripheral wall toward the accommodation space. The second throat portion is spatially corresponding to the first throat portion, disposed adjacent to another lateral end of the outlet, and protruding from the peripheral wall toward the accommodation space. The fan wheel is arranged between the first and second throat portions. When the fan wheel is rotated along the rotational direction, the airflow is guided from the first throat portion to the second throat portion.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE PREFERRED EMBODIMENT

Figure 1:
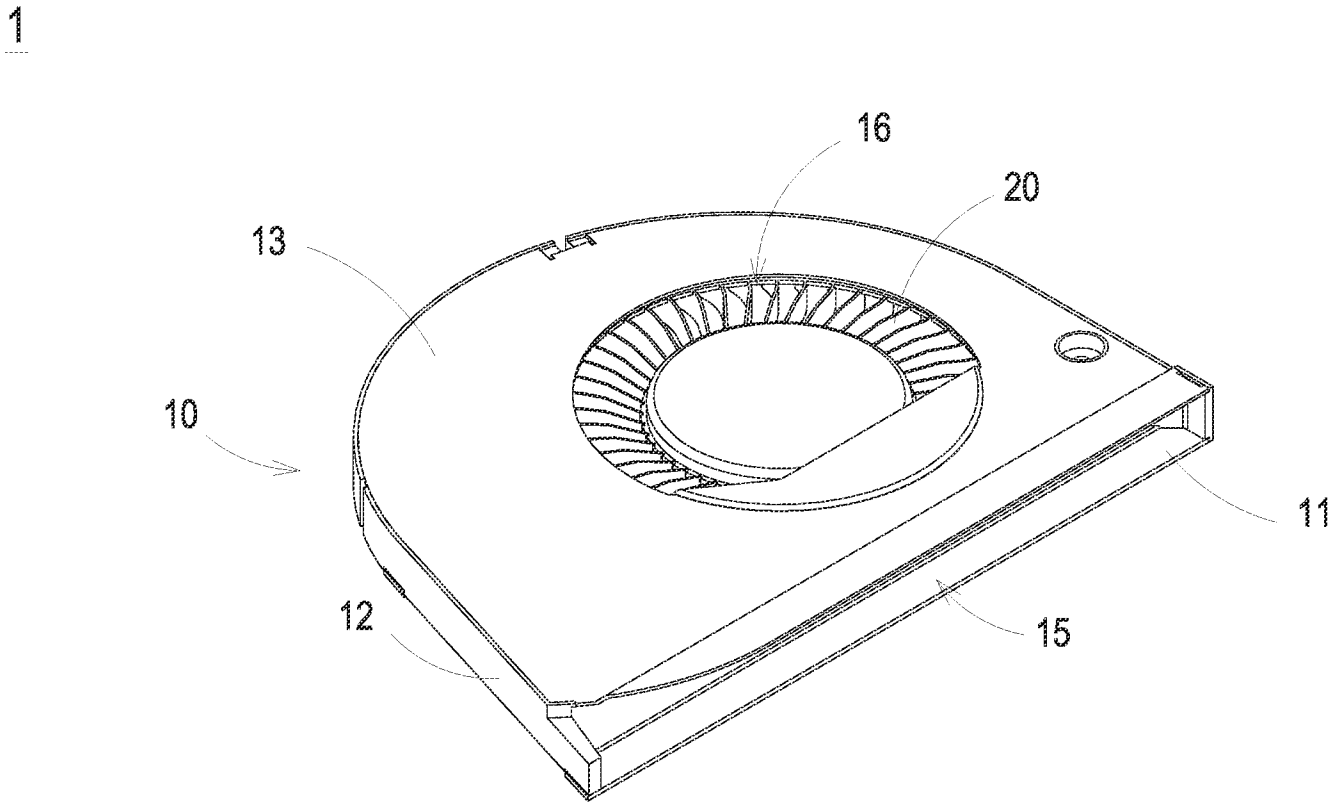
FIG. 1 is a perspective view illustrating a centrifugal fan according to a first embodiment of the present disclosure.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. Further, spatially relative terms, such as "upper", "lower", "bottom", "inner", "outer" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly. When an element is referred to as being "connected" or "coupled" to another element, it can be directly connected or coupled to the other element or intervening elements may be present. In addition, although the "first", "second" and the like terms in the claims be used to describe the various elements can be appreciated, these elements should not be limited by these terms, and these elements are described in the respective embodiments are used to express the different reference numerals, these terms are only used to distinguish one element from another element. For example, a first element could be termed a second element, and, similarly, a second element could be termed a first element, without departing from the scope of example embodiments.

FIG. 1 is a perspective view illustrating a centrifugal fan according to a first embodiment of the present disclosure. In the embodiment, the centrifugal fan 1 at least includes a housing 10 and a fan wheel 20. The housing 10 includes a lower cover 11, a peripheral wall 12 and an upper cover 13. The lower cover 11 and the upper cover 13 are connected through the peripheral wall 12 to form an outlet 15. Preferably but not exclusively, the upper cover 13 is formed by stamping a metal sheet and includes an inlet 16, which is in fluid communication with the outlet 15. The fan wheel 20 is exposed through the inlet 16.

Figure 2:
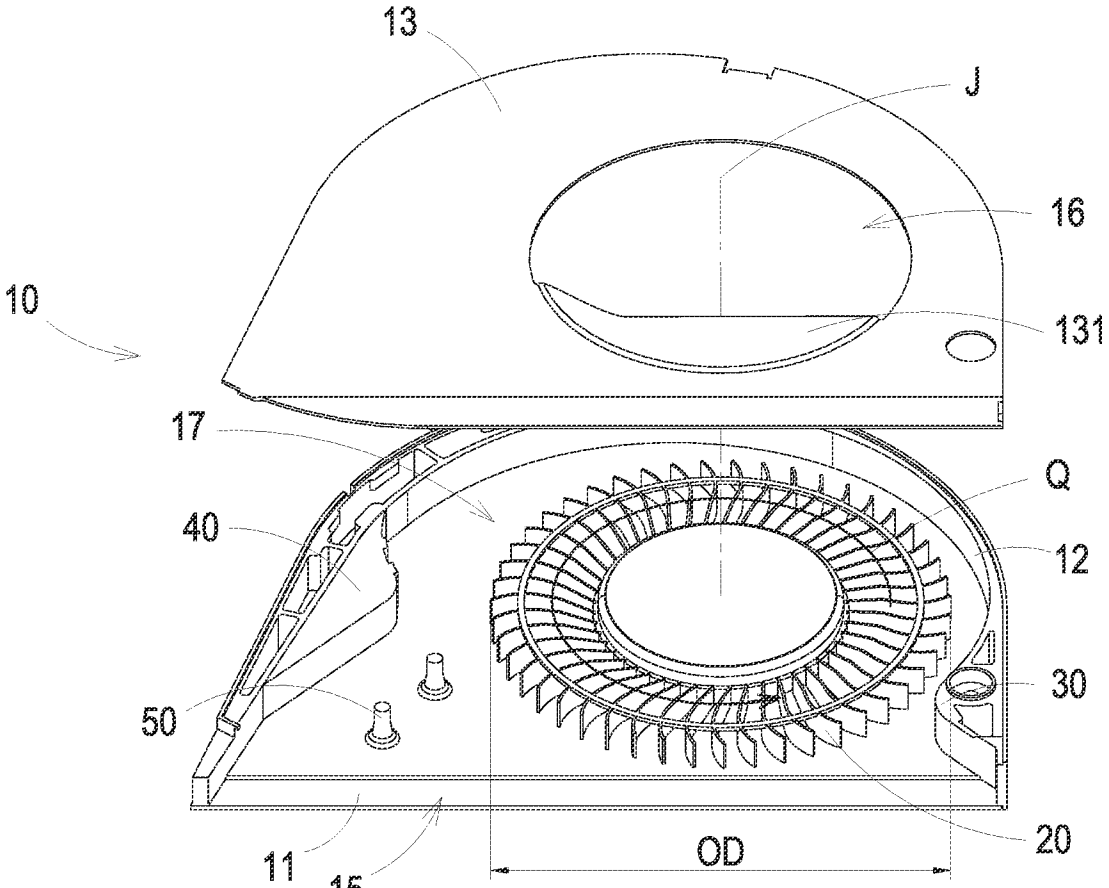
FIG. 2 is an exploded view illustrating the centrifugal fan according to the first embodiment of the present disclosure.

FIG. 2 is an exploded view illustrating the centrifugal fan according to the first embodiment of the present disclosure. The lower cover 11 and the upper cover 13 are connected through the peripheral wall 12 to form an accommodation space 17, and the inlet 16 is in fluid communication with the outlet 15 through the accommodation space 17. The fan wheel 20 is disposed on the lower cover 11. Preferably but not exclusively, the fan wheel 20 has a rotation diameter OD and accommodated in the accommodation space 17. In the embodiment, the fan wheel 20 is driven by a motor (not shown) to rotate in a counterclockwise rotation direction Q around the center J so as to form an airflow, which is inhaled through the inlet 16, flows through the accommodation space 17, and is exported through the outlet 15. In the embodiment, the centrifugal fan 1 further includes a first throat portion 30 and a second throat portion 40. The first throat portion 30 is disposed adjacent to a lateral end of the outlet 15. Moreover, the first throat portion 30 protrudes from the peripheral wall 12 toward the accommodation space 17. The second throat portion 40 is spatially corresponding to the first throat portion 30, and disposed adjacent to another lateral end of the outlet 15. The second throat portion 40 protrudes from the peripheral wall 12 toward the accommodation space 17. The second throat portion 40 is regarded as being located at the downstream of the airflow, and disposed adjacent to the outlet 15. In the embodiment, the fan wheel 20 is arranged between the first and second throat portions 30, 40. When the fan wheel 20 is rotated along the rotational direction Q, the airflow is guided from the first throat portion 30 to the second throat portion 40. Notably, the upper cover 13 further includes a stage 131 disposed adjacent to the inlet 16 so that an outer periphery of the inlet 16 is in a non-circular shape due to the formation of the stage 131. In addition, the centrifugal fan 1 further includes at least one support 50 connected between the lower cover 11 and the upper cover 13, disposed adjacent to the outlet 15 and arranged between the second throat portion 40 and the fan wheel 20. By disposing the second throat portion 40 in the flow tunnel to form a deceleration mechanism for the flowing fluid, and further combining the structure of the irregular inlet 16 formed by punching the stage 131 outwardly from the fan or the structure of the support 50 disposed in the flow tunnel, the fluid velocity is effectively reduced to achieve the effects of reducing the noise and improving the sound quality. The support 50 can be formed with the lower cover 11 and the peripheral wall 12 as a single piece by injection molding.

Figure 3:
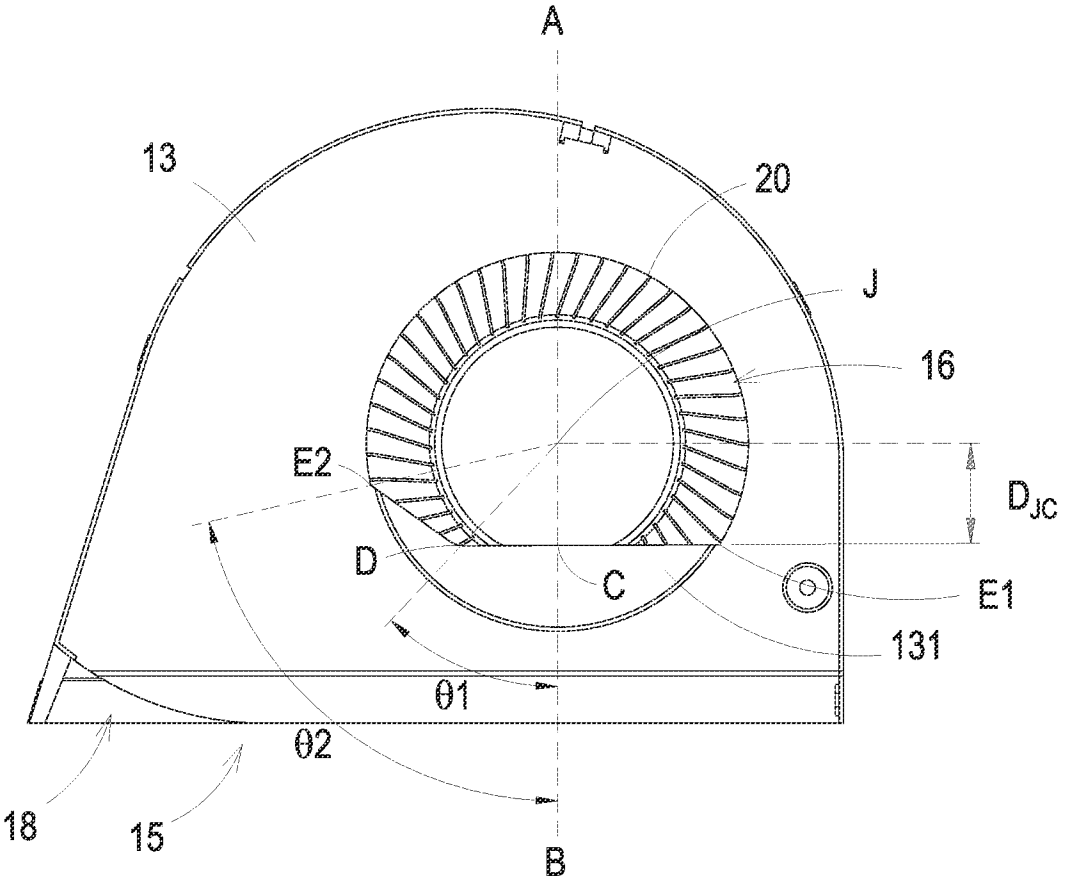
FIG. 3 is a top view illustrating the centrifugal fan according to the first embodiment of the present disclosure.

FIG. 3 is a top view illustrating the centrifugal fan according to the first embodiment of the present disclosure. In the embodiment, the stage 131 and the outer periphery of the inlet 16 are intersected at a first intersection E1 and a second intersection E2. An edge of the stage 131 connected to the inlet 16 has a turning point D. In view of the figure, the outlet 15 faces a direction having an axial line AB passing through the center J of the fan wheel 20, and a connection line of the turning point D and the first intersection E1 is perpendicular to the axial line AB. In the embodiment, the connection line of the turning point D and the first intersection E1 and the axial line AB are intersected at a cross intersection C, the cross intersection C and the center J of the fan wheel 20 have a vertical distance DJC. In the embodiment, the fan wheel 20 has the rotation diameter OD (referring to FIG. 2), and a ratio of the vertical distance DJC to the rotation diameter OB is ranged from 0.1 to 0.35. Furthermore, in the embodiment, as the connection line of the turning point D and the first intersection E1 and the axial line AB are intersected at the cross intersection C, a first included angle θ1 is formed between the turning point D and the cross intersection C with respect to the center J of the fan wheel 20. Preferably but not exclusively, the first included angle θ1 is ranged from 35° to 65°. In the embodiment, as the connection line of the turning point D and the first intersection E1 and the axial line AB are intersected at the cross intersection C, a second included angle θ2 is formed between the second intersection E2 and the cross intersection C with respect to the center J of the fan wheel 20. Preferably but not exclusively, the second included angle θ2 is ranged from 70° to 110°. Thus, the non-circular inlet 16 has a better effect of noise reduction. Certainly, the present disclosure is not limited thereto. In the embodiment, the lower cover 11 further includes an uncovered region 18 disposed adjacent to the second throat portion 40 and the outlet 15. The uncovered region 18 is not covered by the upper cover 13 in view of a direction from the upper cover 13 to the lower cover 11. Thereby, the outlet 15 of the centrifugal fan 1 further corresponds to the second throat portion 40 to provide the varied applications.

Figure 4:
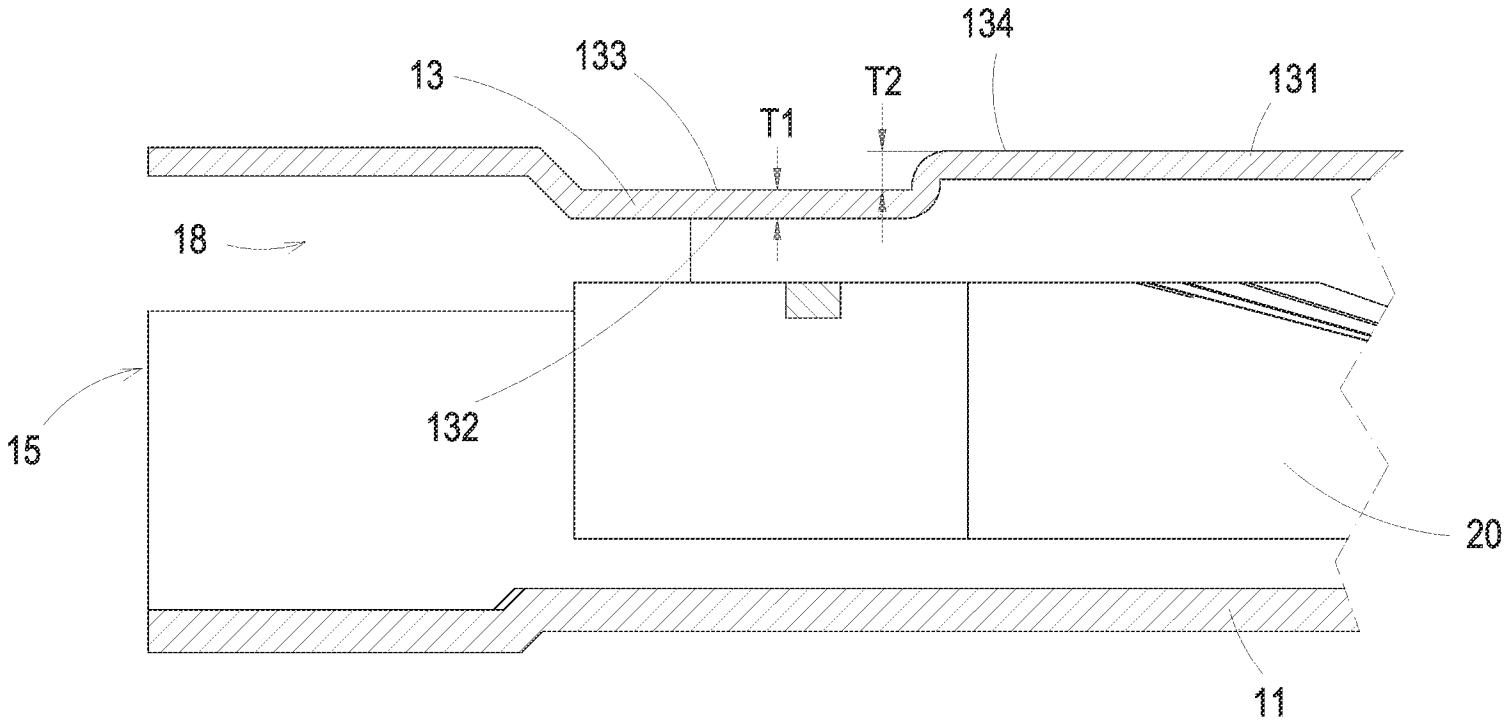
FIG. 4 is a cross-section view illustrating the centrifugal fan and taken along the line BC of FIG. 3.

FIG. 4 is a cross-section view illustrating the centrifugal fan and taken along the line BC of FIG. 3. In the embodiment, on the stage 131 disposed adjacent to the inlet 16, a punched-out surface 134 is formed by punching along a direction from an inner surface 132 toward an outer surface 133 of the upper cover 13. The inner surface 132 and the outer surface 133 of the upper cover 13 have a thickness T1 therebetween. Preferably but not exclusively, the thickness T1 is 0.4 mm. In addition, the punched-out surface 134 of the stage 131 and the outer surface 133 of the upper cover 13 have a punched height T2. Preferably but not exclusively, the punched height T2 is ranged from 0.3 mm to 1.5 mm. In the embodiment, a ratio of the punched height T2 to the thickness T2 is ranged from 0.75 to 3.75, and it facilitates the non-circular inlet 16 to provide the maximum noise-reduction performance relative to the airflow generated by the rotation of the fan wheel 20.

Figure 5:
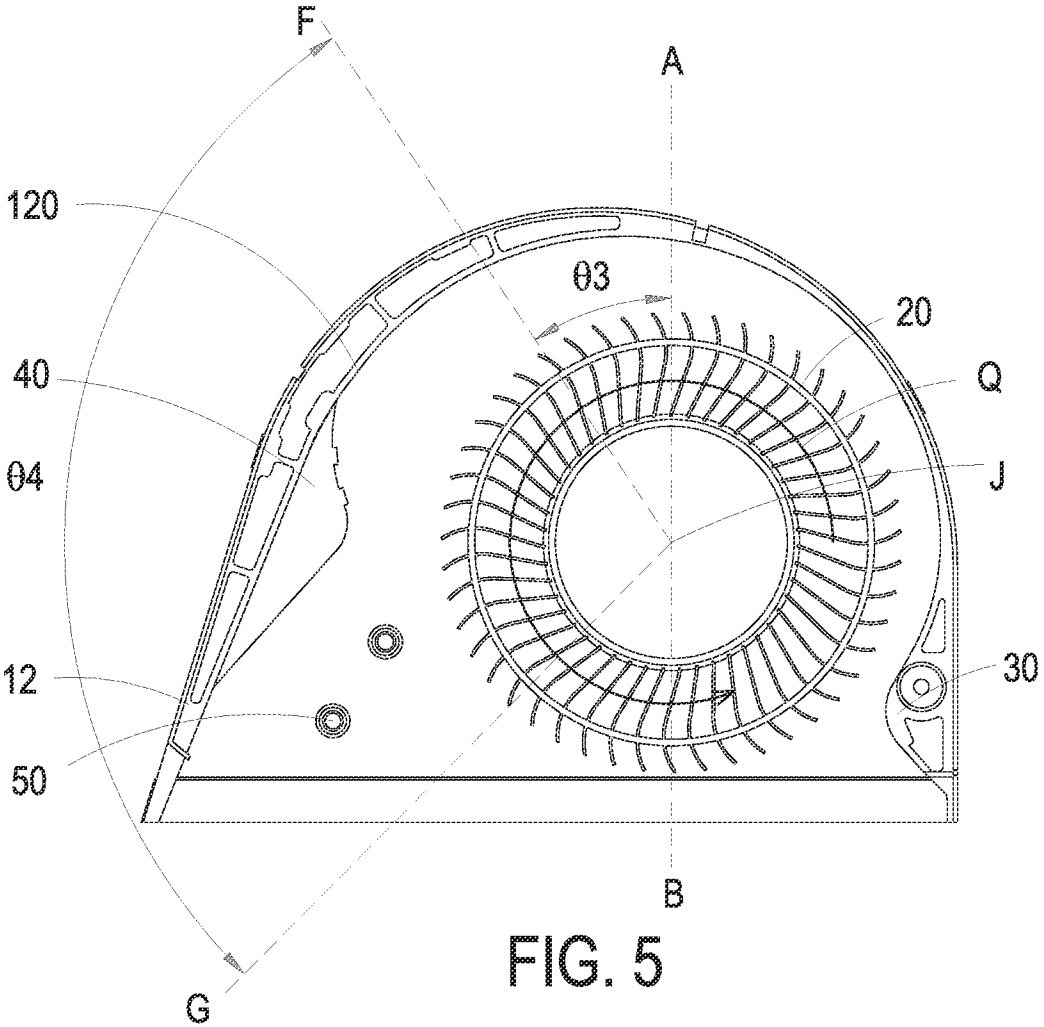
FIG. 5 shows the arrangement relationship of the second throat portion corresponding to the fan wheel in the centrifugal fan according to the first embodiment of the present disclosure.

FIG. 5 shows the arrangement relationship of the second throat portion corresponding to the fan wheel in the centrifugal fan according to the first embodiment of the present disclosure. In the embodiment, the first and second throat portions 30, 40 are located at two opposite sides of the fan wheel 20, respectively. Preferably but not exclusively, the second throat portion 40 is adjustable relative to the fan wheel 20 within a specific range on the inner surface 120 of the peripheral wall 12 to exert the effect of reducing the flow rate. In the embodiment, a first setting angle is formed between the second throat portion 40 and the axial line AB relative to the center J of the fan wheel 20 in the rotation direction Q, and the first setting angle is located within the range of ∠FJG. In the rotation direction Q, the minimum included angle of the second throat portion 40 and the axial line AB is ∠AJF=θ3=35°. In the rotation direction Q, the maximum included angle of the second throat portion 40 and the axial line AB is ∠AJG=θ3+θ4=135°. Namely, the first setting angle is ranged from 35° to 135°. Thus, it facilitates the second throat portion 40 to provide the maximum noise-reduction performance relative to the airflow generated by the rotation of the fan wheel 20.

Figure 6:
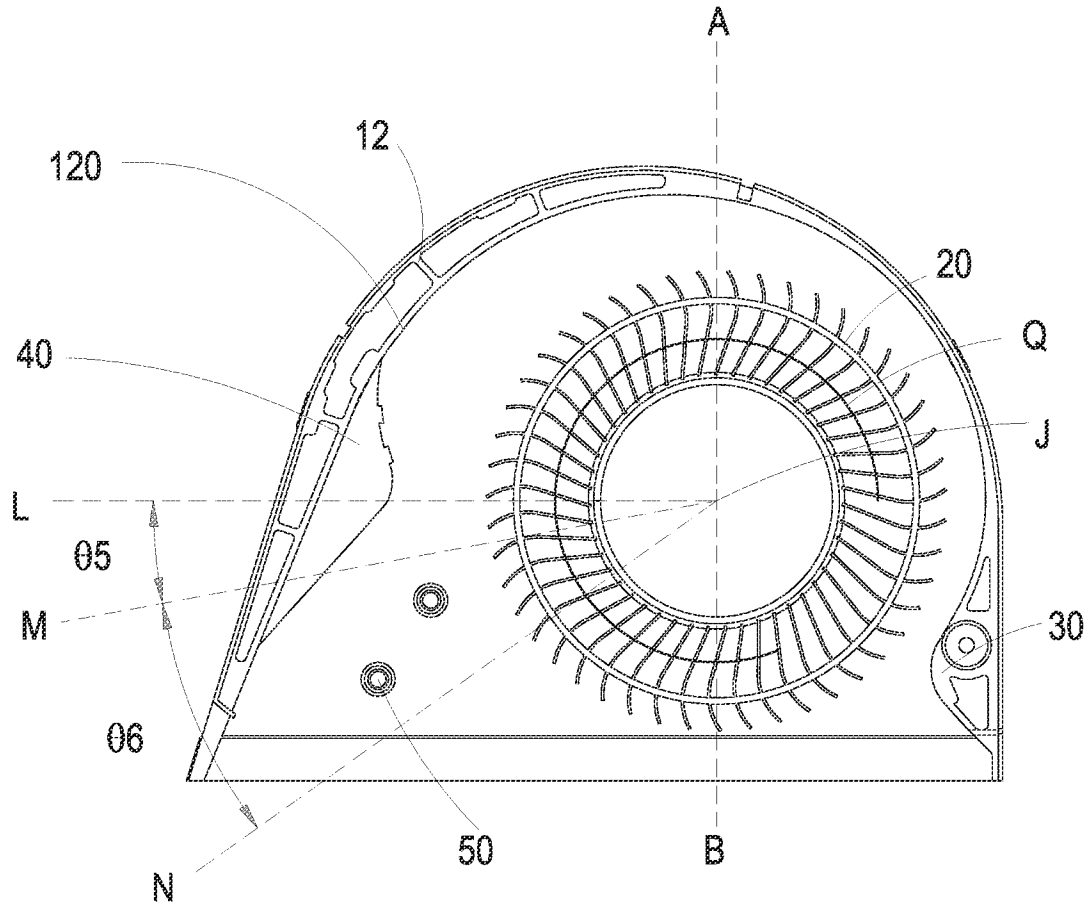
FIG. 6 shows the arrangement relationship of the support corresponding to the fan wheel in the centrifugal fan according to the first embodiment of the present disclosure.

FIG. 6 shows the arrangement relationship of the support corresponding to the fan wheel in the centrifugal fan according to the first embodiment of the present disclosure. In the embodiment, the at least one support 50 is connected between the lower cover 11 and the upper cover 13, disposed adjacent to the outlet, and arranged between the second throat portion 40 and the fan wheel 20. In other embodiment, the position of the support 50 is adjustable relative to the fan wheel 20. In the embodiment, a second setting angle is formed between the support 50 and the axial line AB relative to the center J of the fan wheel 20 in the rotation direction Q, and the second setting angle is located within the range of ∠MJN. In the rotation direction Q, the minimum included angle of the support 50 and the axial line AB is ∠AJM=∠AJL+θ5=90°+10°=100°. In the rotation direction Q, the maximum included angle of the support 50 and the axial line AB is AJN=∠AJL+θ5+θ6=90°+10°+25°=125°. Namely, the second setting angle is ranged from 100° to 125°. Thus, it facilitates the support 50 to provide the maximum noise-reduction performance relative to the airflow generated by the rotation of the fan wheel 20. Furthermore, the support 50 is helpful to maintain the distance between the lower cover 11 and the upper cover 13 and maintain and the overall structural strength of the centrifugal fan 1. In other embodiments, the support 50 is omitted, and the present disclosure is not limited thereto.

Figure 7:
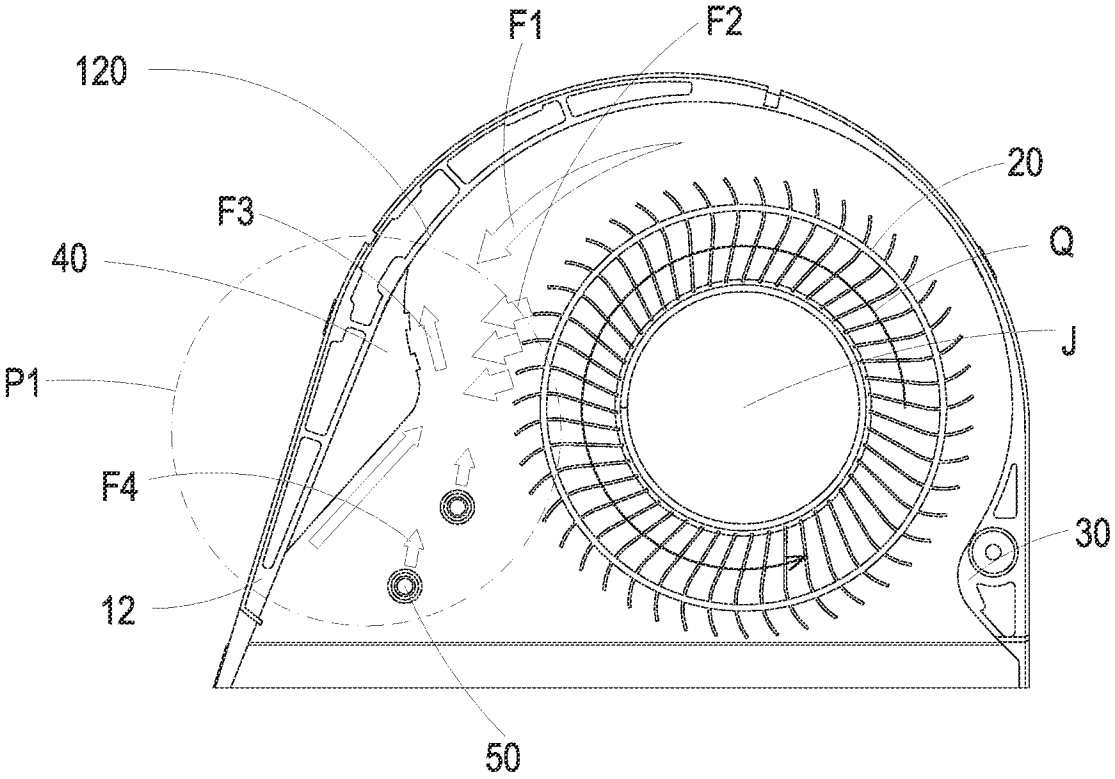
FIG. 7 shows the airflow distribution in the centrifugal fan according to the first embodiment of the present disclosure.

FIG. 7 shows the airflow distribution in the centrifugal fan according to the first embodiment of the present disclosure. In the embodiment, the airflow generated by the fan wheel 20 rotating in the rotation direction Q further includes a first airflow F1 and a second airflow F2. The first airflow F1 is guided from the first throat portion 30 to the second throat portion 40 along the rotation direction Q, and the second airflow F2 is blown by the fan wheel 20 directly to the second throat portion 40. In the embodiment, a third airflow F3 is generated by the second throat portion 20 relative to the first airflow F1 guided from the first throat portion 30 to the second throat portion 40 along the rotation direction Q and the second airflow F2 blown by the fan wheel 20 directly to the second throat portion 40. Namely, the third airflow F3 is opposite to the rotation direction Q so that the fluids are directed to collide with each other and decelerate. Furthermore, for the first and second airflows F1, F2 acting on the second throat portion 40, a fourth airflow F4 is generated by at least one the support 50 relative to the first and second airflows F1, F2 and opposite to the rotation direction Q so as to reduce the flow velocity of the fluids near the outlet 15, thereby achieving the effects of reducing noise and the prominence ratio and improving the sound quality. Certainly, the present disclosure is not limited thereto.

Figure 8:
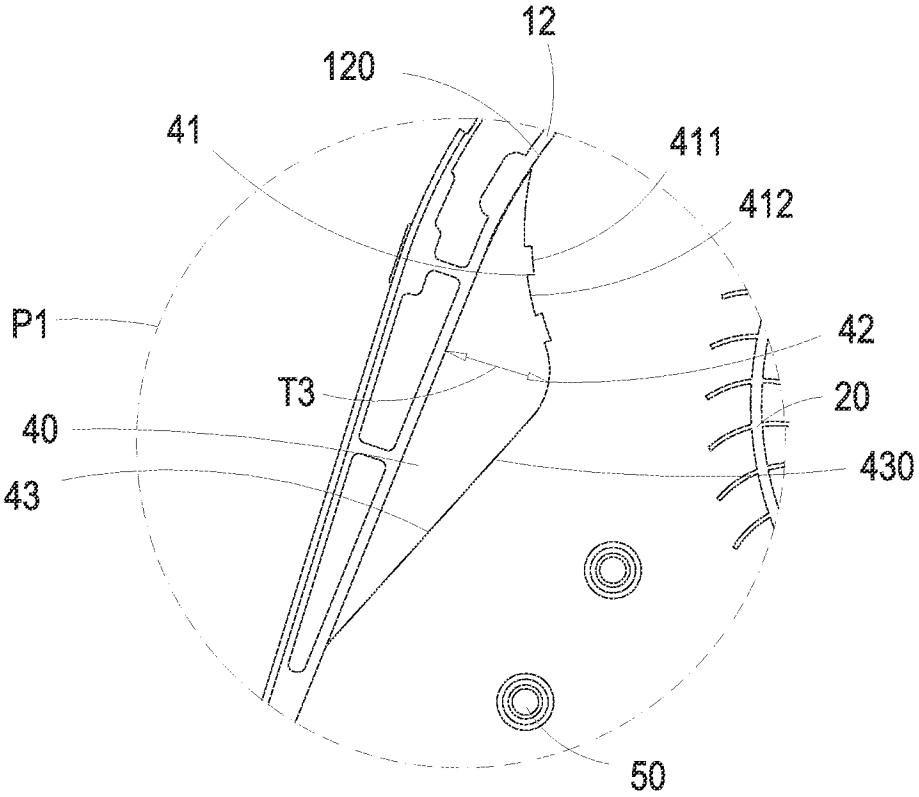
FIG. 8 is an enlarged view showing the region P1 in FIG. 7.

FIG. 8 is an enlarged view showing the region P1 in FIG. 7. Please refer to FIG. 7 and FIG. 8. In the embodiment, the second throat portion 40 is added and corresponding to the first throat portion 30 in the rotation direction Q, and the second throat portion 40 further includes a first curved wall 41 and a second curved wall 43. The first and second curved walls 41, 43 are arranged in sequence along the rotation direction Q of the fan wheel 20. In the embodiment, the first curved wall 41 faces the first airflow F1 directed from the first throat portion 30 to the second throat portion 40, and the first curved wall 41 faces the second airflow F2 directly blown by the fan wheel 20 to the second throat portion 40. Therefore, the first curved wall 41 is regarded as a windward surface. In the embodiment, the distance between the first curved wall 41 and the peripheral wall 12 is increased along the rotation direction Q to form a peak 42, and the peak 42 is connected to the second curved wall 43. The distance between the second curved wall 43 and the peripheral wall 12 is decreased along the rotation direction Q, so as to form a downstream flow of the third airflow F3. In the embodiment, a peak distance T3 is formed between the peak 42 and the inner surface 120 of the peripheral wall 12. Preferably but not exclusively, the peak distance T3 is greater than 1.5 mm. In addition, the first curved wall 41 further includes at least one protrusion 411 and at least one recess 412 arranged alternately with each other, so as to form a concave-convex deceleration groove. The second curved wall 43 includes a smooth surface 430. Thus, the third airflow F3 formed by the second throat portion 40 is more helpful to achieve the effects of reducing the noise and the prominence ratio.

Figure 9:
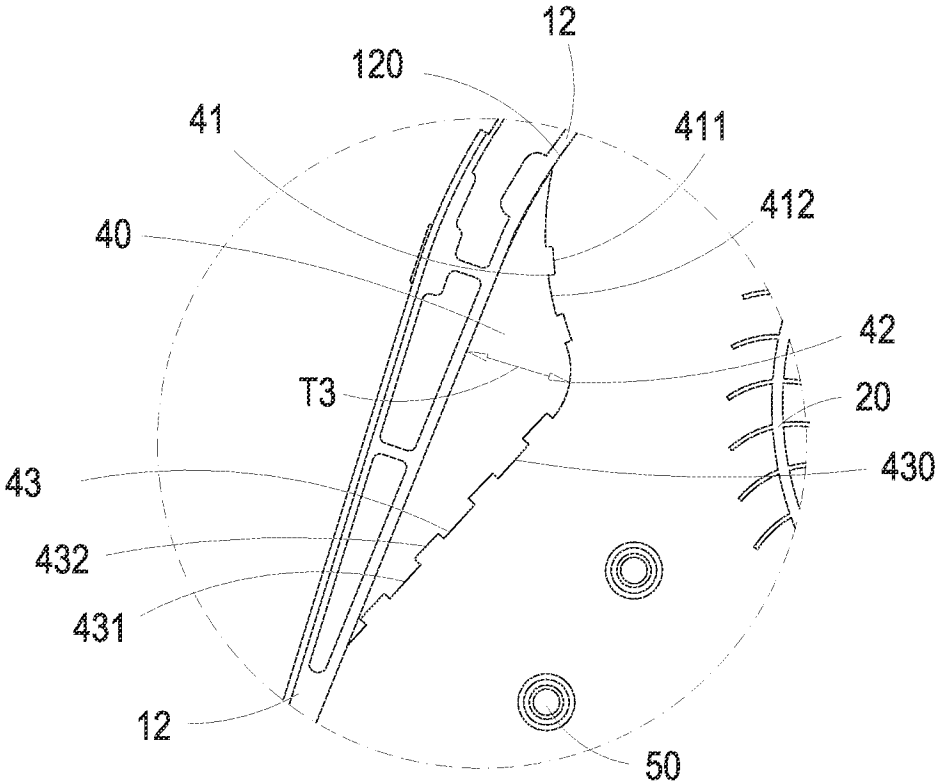
FIG. 9 is a partial enlarged view illustrating a centrifugal fan according to a second embodiment of the present disclosure.

FIG. 9 is a partial enlarged view illustrating a centrifugal fan according to a second embodiment of the present disclosure. In the embodiment, the second throat portion 40 includes a first curved wall 41 and the second curved wall 43. The first and second curved walls 41, 43 are arranged in sequence along the rotation direction Q of the fan wheel 20 (referring to FIG. 7). In the embodiment, the distance between the first curved wall 41 and the peripheral wall 12 is increased along the rotation direction Q to form a peak 42, the peak 42 is connected to the second curved wall 43, and the distance between the second curved wall 43 and the peripheral wall 12 is decreased along the rotation direction Q. Preferably but not exclusively, a peak distance T3 formed between the peak 42 and the inner surface 120 of the peripheral wall 12 is greater than 1.5 mm. In the embodiment, the first curved wall 41 includes at least one protrusion 411 and at least one recess 412 arranged alternately with each other to form the concave-convex deceleration groove. Moreover, the second curved wall 43 includes at least one protrusion 431 and at least one recess 432 arranged alternately with each other to form a concave-convex deceleration groove. Thus, the third airflow F3 (referring to FIG. 7) formed by the second throat portion 40 is more helpful to achieve the effects of reducing the noise and the prominence ratio.

Figure 10:
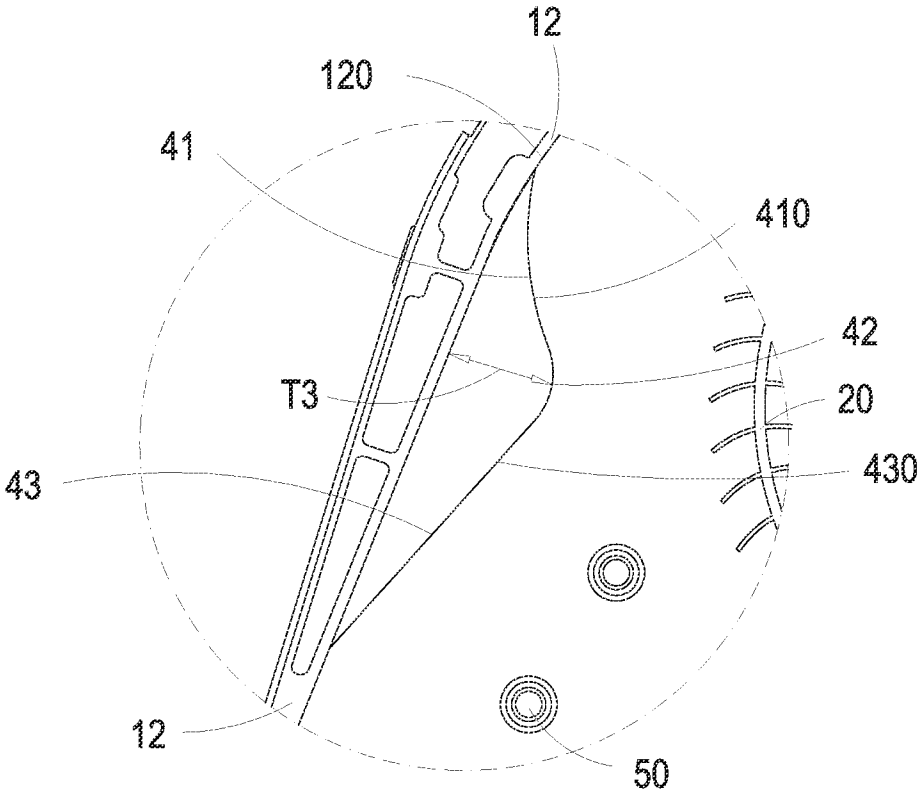
FIG. 10 is a partial enlarged view illustrating a centrifugal fan according to a third embodiment of the present disclosure.
Figure 11:
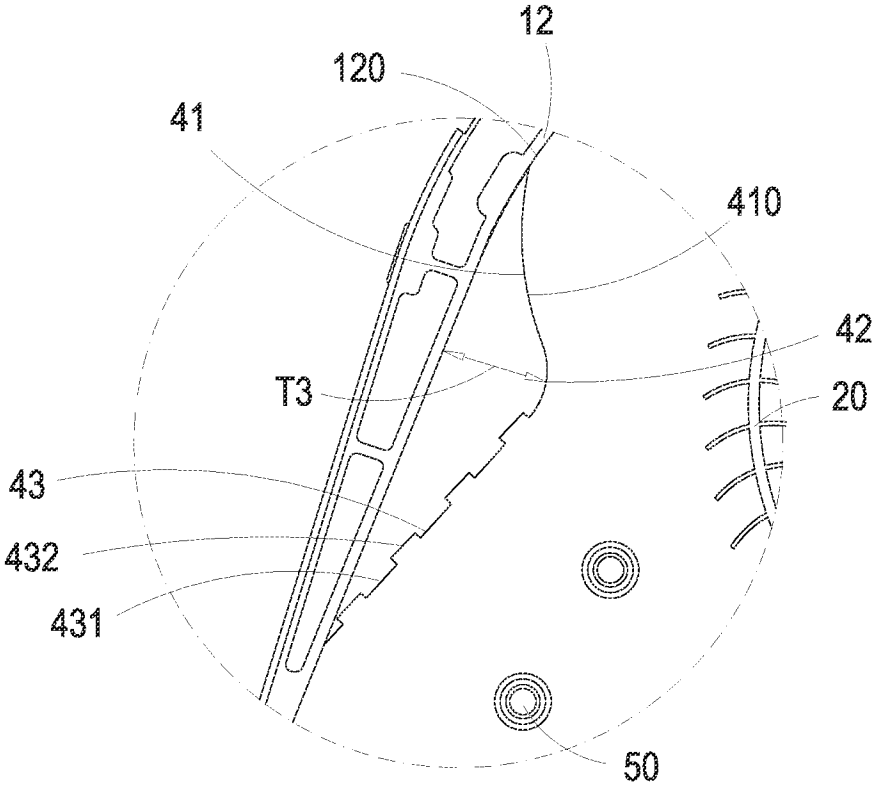
FIG. 11 is a partial enlarged view illustrating a centrifugal fan according to a fourth embodiment of the present disclosure.

FIG. 10 is a partial enlarged view illustrating a centrifugal fan according to a third embodiment of the present disclosure. Preferably but not exclusively, in the embodiment, the first curved wall 41 includes a smooth surface 410, and the second curved wall 43 includes a smooth surface 430. FIG. 11 is a partial enlarged view illustrating a centrifugal fan according to a fourth embodiment of the present disclosure. Preferably but not exclusively, in the embodiment, the first curved wall 41 includes a smooth surface 410 and the second curved wall 43 includes at least one protrusion 431 and at least one recess 432 arranged alternately with each other to form a concave-convex deceleration groove. Thus, the third airflow F3 (referring to FIG. 7) formed by the second throat portion 40 is more helpful to achieve the effects of reducing the noise and the prominence ratio.

Figure 12:
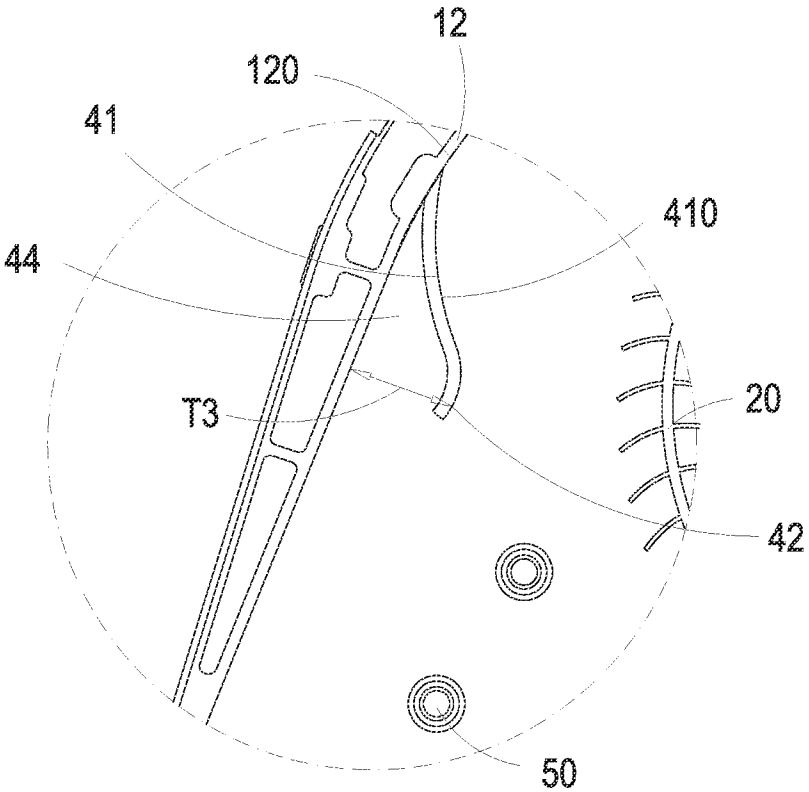
FIG. 12 is a partial enlarged view illustrating a centrifugal fan according to a fifth embodiment of the present disclosure.

FIG. 12 is a partial enlarged view illustrating a centrifugal fan according to a fifth embodiment of the present disclosure. In the embodiment, the second throat portion 40 includes a first curved wall 41. The distance between the first curved wall 41 and the peripheral wall 12 is increased along the rotation direction Q to form a peak 42, and a peak distance T3 formed between the peak 42 and the inner surface 120 of the peripheral wall 12 is greater than 1.5 mm. Preferably but not exclusively, in the embodiment, the first curved wall 41 is formed by a metal sheet and includes a smooth surface 410 formed by a metal sheet. In the embodiment, the second throat portion 40 further includes an interval space 44 disposed between the first curved wall 41 and the peripheral wall 12 and in fluid communication with the accommodation space 17. Thus, the second throat portion 40 is helpful to achieve the effects of reducing the noise and the prominence ratio.

Figure 13:
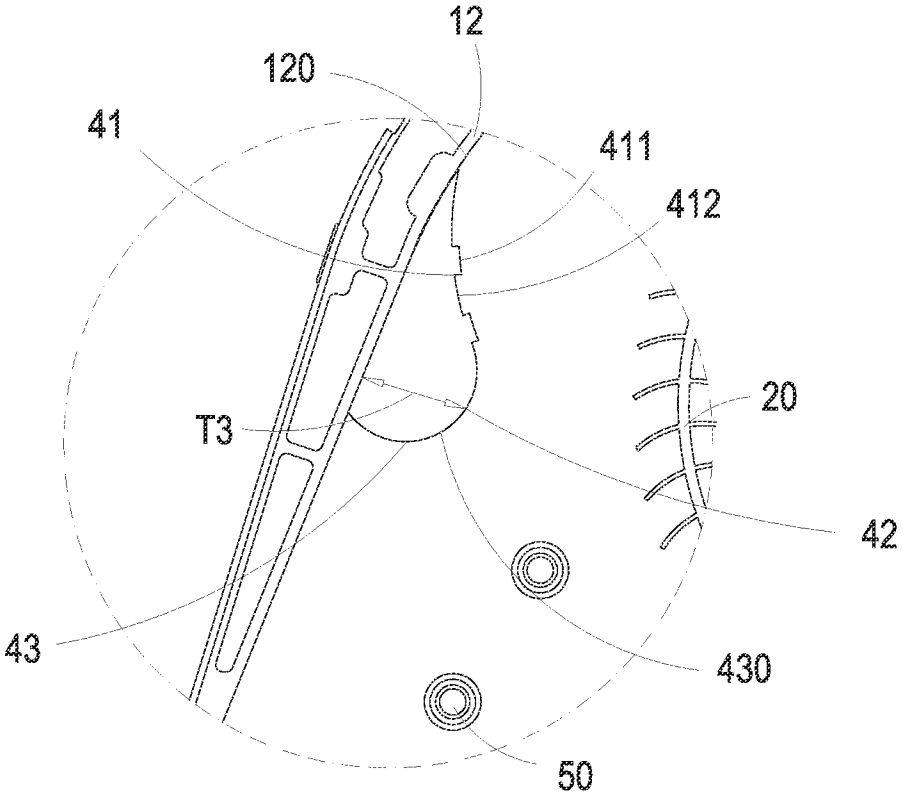
FIG. 13 is a partial enlarged view illustrating a centrifugal fan according to a sixth embodiment of the present disclosure.

FIG. 13 is a partial enlarged view illustrating a centrifugal fan according to a sixth embodiment of the present disclosure. In the embodiment, the second throat portion 40 includes a first curved wall 41 and the second curved wall 43. The first and second curved walls 41, 43 are arranged in sequence along the rotation direction Q of the fan wheel 20 (referring to FIG. 7). In the embodiment, the distance between the first curved wall 41 and the peripheral wall 12 is increased along the rotation direction Q to form a peak 42, and the peak 42 is connected to the second curved wall 43. Preferably but not exclusively, a peak distance T3 formed between the peak 42 and the inner surface 120 of the peripheral wall 12 is greater than 1.5 mm. In the embodiment, the first curved wall 41 includes at least one protrusion 411 and at least one recess 412 arranged alternately with each other to form the concave-convex deceleration groove. Moreover, the second curved wall 43 forms an arc shape with a radius smaller than the peak distance T3. Thus, the third airflow F3 (referring to FIG. 7) formed by the second throat portion 40 is more helpful to achieve the effects of reducing the noise and the prominence ratio.

Figure 14:
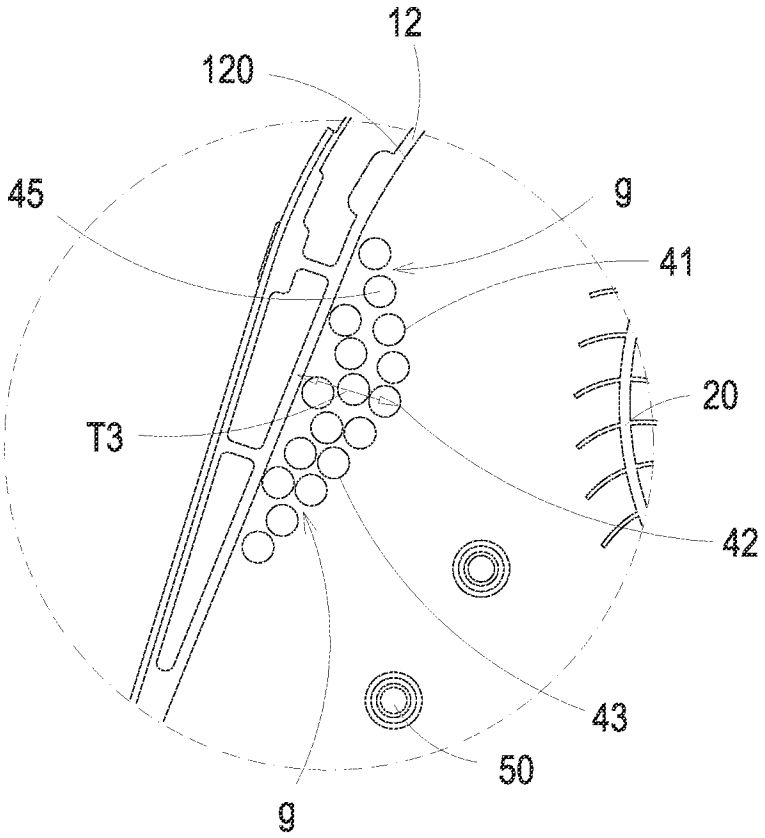
FIG. 14 is a partial enlarged view illustrating a centrifugal fan according to a seventh embodiment of the present disclosure.
Figure 15:
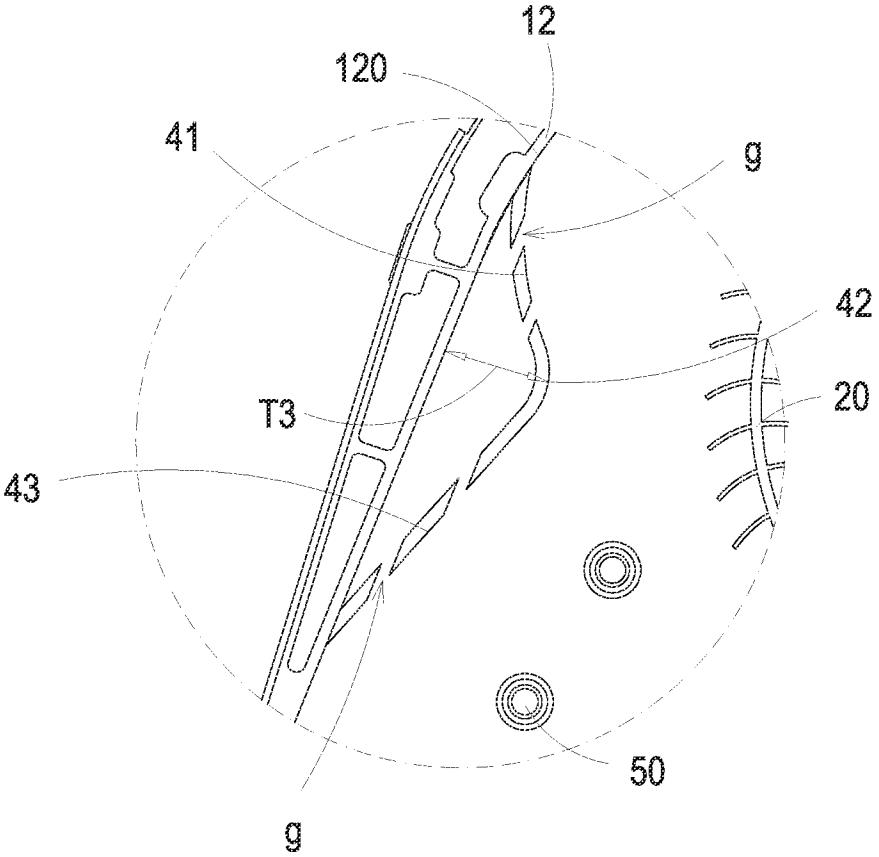
FIG. 15 is a partial enlarged view illustrating a centrifugal fan according to an eighth embodiment of the present disclosure.

FIG. 14 is a partial enlarged view illustrating a centrifugal fan according to a seventh embodiment of the present disclosure. Preferably but not exclusively, in the embodiment, the second throat portion 40 includes a plurality of columns 45 so as to form the first and second curved walls 41, 43. In that, the first and second curved walls 41, 43 include at least one gap g, respectively. FIG. 15 is a partial enlarged view illustrating a centrifugal fan according to an eighth embodiment of the present disclosure. Preferably but not exclusively, in the embodiment, the second throat portion 40 is made of a sheet to form the first and second curved walls 41, 43. Moreover, the first and second curved walls 41, 43 include at least one gap g, respectively. In other embodiments, the first and second curved walls 41, 43 are adjustable according to the practical requirements, and allowed including a smooth surface 410, 430, a convex portion 411, 431, a concave portion 412, 432, a gap g, an interval space 44 or cylinders 45, so as to improve the practicability of the second throat portion 40. Compared with the conventional fan that only includes the first throat portion, the centrifugal fan 1 of the present disclosure includes the additional second throat portion 40, so that the sound pressure level (SPL) is effectively reduced under the condition of the same rotational speed, and the performance of the centrifugal fan 1 is improved. Moreover, the prominence ratio (PR) is reduced significantly, the generation of prominent abnormal noise is avoided, and the sound quality of the centrifugal fan 1 is optimized.

From the above descriptions, it can be seen that, with the second throat portion 40 added to form the deceleration mechanism, and combined with the structure of the irregular inlet 16 or the support 50, the fluid velocity is effectively reduced to achieve the effects of reducing the noise and improving the sound quality. Notably, the types, the sizes, the positions and the arrangements of the second throat portion 40, the inlet 16 and the support 50 are adjustable according the practical requirements. Certainly, the centrifugal fan 1 of the present disclosure is allowed combining and changing the features of the foregoing embodiments according to the actual application requirements. The present disclosure is not limited thereto.

In summary, the present disclosure provides a centrifugal fan with the design of a plurality of throat portions, an irregular inlet and a support to reduce the fluid velocity, thereby achieving the effects of reducing the noise and the prominence ratio and improving the sound quality. The second throat portion is disposed in the flow tunnel to form a deceleration mechanism, and further combined with the structure of the irregular inlet formed by punching a stage outwardly from the fan or the structure of the support disposed in the flow tunnel. Thereby, the fluid velocity is effectively reduced to achieve the effects of reducing the noise and improving the sound quality. The stage punched outwardly from the irregular inlet further forms a turning angle, and it facilitates the inlet to achieve the effects of reducing the noise of the incoming air and maintaining the air volume at the same time. Furthermore, the height of the stage punched outward from the inlet is helpful of increasing the strength of the fan and avoiding the interference between the fan wheel and the inlet. In addition, the second throat portion is spatially corresponding to the first throat portion. The first and second throat portions are disposed along the rotation direction of the fan wheel and are located at two opposite sides of the fan wheel, respectively. The second throat portion is disposed within a specific range to exert the effect of reducing the flow rate. Relative to the first airflow guided from the first throat portion to the second throat portion along the rotation direction and the second airflow blown by the fan wheel directly to the second throat portion, a third airflow in the opposite direction is generated by the second throat portion, so that the fluids are directed to collide with each other and decelerate. Furthermore, for the first and second airflows acting on the second throat portion, a fourth airflow is generated by more than one support to reduce the flow velocity of the fluids near the outlet, thereby achieving the effects of reducing noise and the prominence ratio and improving the sound quality. The second throat portion is added and corresponding to the first throat portion in the rotation direction, and the second throat portion further includes a first curved wall and a second curved wall. The first curved wall faces the first airflow directed from the first throat portion to the second throat portion, and the first curved wall faces the second airflow directly blown by the fan wheel to the second throat portion. Therefore, the first curved wall is regarded as a windward surface. The distance between the first curved wall and the peripheral wall is increased along the rotation direction to form a peak, and then the peak is connected to second curved wall. The distance between the second curved wall and the peripheral wall is decreased along the rotation direction, so as to form a downstream flow of the third airflow. In this way, the third airflow formed by the second throat portion is more helpful to achieve the effects of reducing the noise and the prominence ratio. The first and second curved walls are adjustable according to the practical requirements, and allowed including a smooth surface, a convex portion, a concave portion, a gap, an interval space or cylinders, so as to improve the practicability of the second throat portion. Compared with the conventional fan that only includes the first throat portion, the centrifugal fan of the present disclosure includes the additional second throat portion, so that the sound pressure level (SPL) is effectively reduced under the condition of the same rotational speed, and the performance of the centrifugal fan is improved. Moreover, the prominence ratio (PR) is reduced significantly, the generation of prominent abnormal noise is avoided, and the sound quality of the centrifugal fan is optimized.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A centrifugal fan, comprising:

a housing comprising a lower cover, a peripheral wall and an upper cover, wherein the lower cover and the upper cover are connected through the peripheral wall to form an accommodation space and an outlet, the upper cover comprises an inlet, and the inlet is in fluid communication with the outlet through the accommodation space, wherein the upper cover comprises a stage disposed adjacent to the inlet, the stage and an outer periphery of the inlet are intersected at a first intersection and a second intersection, and an edge of the stage connected to the inlet has a turning point, wherein the outlet faces a direction having an axial line passing through the center of the fan wheel, and a connection line of the turning point and the first intersection is perpendicular to the axial line, wherein the stage is a punched-out surface formed by punching along a direction from an inner surface toward an outer surface of the upper cover;

a fan wheel disposed on the lower cover and accommodated in the accommodation space, wherein the fan wheel is rotated along a rotation direction to form an airflow, which is inhaled through the inlet, flows through the accommodation space, and is exported through the outlet;

a first throat portion disposed adjacent to a lateral end of the outlet and protruding from the peripheral wall toward the accommodation space; and a second throat portion spatially corresponding to the first throat portion, disposed adjacent to another lateral end of the outlet, and protruding from the peripheral wall toward the accommodation space, wherein the fan wheel is arranged between the first and second throat portions, wherein when the fan wheel is rotated along the rotational direction, the airflow is guided from the first throat portion to the second throat portion.

2. The centrifugal fan according to claim 1, wherein the inlet is in a non-circular shape.

3. The centrifugal fan according to claim 1, further comprising at least one support connected between the lower cover and the upper cover, disposed adjacent to the outlet, and arranged between the second throat portion and the fan wheel.

4. The centrifugal fan according to claim 1, wherein the lower cover comprises includes an uncovered region disposed adjacent to the second throat portion and the outlet, and the uncovered region is not covered by the upper cover in view of a direction from the upper cover to the lower cover.

5. The centrifugal fan according to claim 1, wherein the inner surface and the outer surface of the upper cover have a thickness therebetween, the punched-out surface of the stage and the outer surface of the upper cover have a punched height, and a ratio of the punched height to the thickness is ranged from 0.75 to 3.75.

6. The centrifugal fan according to claim 5, wherein the fan wheel has a rotation diameter, wherein the connection line of the turning point and the first intersection and the axial line are intersected at a cross intersection, the cross intersection and the center of the fan wheel have a vertical distance, and a ratio of the vertical distance to the rotation diameter is ranged from 0.1 to 0.35.

7. The centrifugal fan according to claim 5, wherein the connection line of the turning point and the first intersection and the axial line are intersected at a cross intersection, a first included angle is formed between the turning point and the cross intersection with respect to the center of the fan wheel, and the first included angle is ranged from 35° to 65°.

8. The centrifugal fan according to claim 5, wherein the connection line of the turning point and the first intersection and the axial line are intersected at a cross intersection, a second included angle is formed between the second intersection and the cross intersection with respect to the center of the fan wheel, and the second included angle is ranged from 70° to 110°.

9. The centrifugal fan according to claim 5, wherein a first setting angle is formed between the second throat portion and the axial line relative to the center of the fan wheel in the rotation direction, the first setting angle is ranged from 35° to 135°.

10. The centrifugal fan according to claim 5, further comprising at least one support connected between the lower cover and the upper cover, disposed adjacent to the outlet, and arranged between the second throat portion and the fan wheel, wherein a second setting angle is formed between the support and the axial line relative to the center of the fan wheel in the rotation direction, the second setting angle is ranged from 100° to 125°.

11. The centrifugal fan according to claim 1, wherein the second throat portion comprises a first curved wall, and distance between the first curved wall and the peripheral wall is increased along the rotation direction to form a peak.

12. The centrifugal fan according to claim 11, wherein a peak distance is formed between the peak and the peripheral wall, and the peak distance is greater than 1.5 mm.

13. The centrifugal fan according to claim 11, wherein the second throat portion further comprises a second curved wall connected to the first curved wall through the peak, and distance between the second curved wall and the peripheral wall is decreased along the rotation direction.

14. The centrifugal fan according to claim 13, wherein the first curved wall or/and the second curved wall comprise a smooth surface.

15. The centrifugal fan according to claim 13, wherein the first curved wall or/and the second curved wall comprise at least one protrusion and at least one recess arranged alternately with each other.

16. The centrifugal fan according to claim 13, wherein the first curved wall or/and the second curved wall comprise at least one gap.

17. The centrifugal fan according to claim 13, wherein the first curved wall or/and the second curved wall comprise a plurality of columns.

18. The centrifugal fan according to claim 11, wherein the second throat portion further comprises an interval space disposed between the first curved wall and the peripheral wall and in fluid communication with the accommodation space.

19. The centrifugal fan according to claim 1, wherein the airflow comprises a first airflow and a second airflow, the first airflow is guided from the first throat portion to the second throat portion along the rotation direction, and the second airflow is blown by the fan wheel directly to the second throat portion.

20. The centrifugal fan according to claim 19, wherein a third airflow is generated by the second throat portion relative to the first and second airflows and opposite to the rotation direction.

21. The centrifugal fan according to claim 19, further comprising at least one support connected between the lower cover and the upper cover, disposed adjacent to the outlet, and arranged between the second throat portion and the fan wheel, wherein a fourth airflow is generated by the support relative to the first and second airflows and opposite to the rotation direction.

* * * * *